United States Patent [19]

Satake

[11] 4,252,240

[45] Feb. 24, 1981

[54] AUTOMATIC CONTROL DEVICE FOR PARTICLE COLOR DISCRIMINATING APPARATUS

[75] Inventor: Toshihiko Satake, Higashihiroshima, Japan

[73] Assignee: Satake Engineering Co., Ltd., Tokyo, Japan

[21] Appl. No.: 104,745

[22] Filed: Dec. 17, 1979

[30] Foreign Application Priority Data

Dec. 25, 1978 [JP] Japan ..... 53-162901
Aug. 2, 1979 [JP] Japan ..... 54-99776

[51] Int. Cl.[3] ..... B07C 5/342

[52] U.S. Cl. ..... 209/580; 209/639; 209/920

[58] Field of Search ..... 209/509, 576, 577, 580, 209/581, 587, 588, 639, 920

[56] References Cited

U.S. PATENT DOCUMENTS

| | | | |
|---|---|---|---|
| 3,179,247 | 4/1965 | Hutter et al. | 209/577 |
| 3,545,610 | 12/1970 | Kelly et al. | 209/920 |
| 3,990,580 | 11/1976 | Self | 209/920 |
| 4,194,634 | 3/1980 | Kelly | 209/576 X |

*Primary Examiner*—Joseph J. Rolla
*Attorney, Agent, or Firm*—Norbert P. Holler; Charles A. Blank

[57] ABSTRACT

A particle color discriminating apparatus including a vibration feeder for feeding particles to be discriminated, a shooter for causing the particles from the feeder to flow downwardly, photoelectric detecting means located in the vicinity of a path of flow of the particles in a predetermined locus, an air ejector arranged beneath the photoelectric detecting means and control means for controlling the actuation of the air ejector in accordance with an output signal of the photosensitive detector is provided with an automatic control device operative to control the amount of particles supplied by the vibration feeder in accordance with changes in the proportion of particles distinct in color from the particles of interest in the particles supplied.

3 Claims, 7 Drawing Figures

AUTOMATIC CONTROL DEVICE FOR PARTICLE COLOR DISCRIMINATING APPARATUS

BACKGROUND OF THE INVENTION

This invention relates to a particle color discriminating apparatus comprising a vibration feeder for feeding particles to be discriminated, a shooter for causing the particles to flow downwardly in a stream of a predetermined locus, photoelectric detecting means located in the vicinity of the path of flow of the particles from the shooter for detecting particles distinct in color from the particles of interest (hereinafter referred to as particles of dissimilar colors), an air ejector arranged beneath the photoelectric detecting means, and control means for controlling actuation of the air ejector in accordance with an output signal of the photoelectric detecting means for separating the particles of dissimilar colors by the action of air blasts from the air ejector, and more particularly to an automatic control device for the particle color discriminating apparatus of the type described.

In this type of particle color discriminating apparatus of the prior art, such as grain particle color discriminating apparatus, when the proportion of foreign matter incorporated in the grain particles suddenly increases, the foreign matter flows substantially continuously and the operation of the apparatus is thrown into confusion so that the precision with which discrimination is effected is lowered, because there are limits to the operation time of the discriminating apparatus including the photoelectric detecting means and air ejector in handling the same flow rate of particles when the proportion of foreign matter incorporated in the particles becomes high as when it is low. Therefore, the apparatus of the prior art is provided with a control circuit for producing a signal for interrupting the operation of the vibration feeder in such critical conditions. The apparatus of the prior art has had the disadvantage that it is shut down unnoticed and the apparatus is kept inoperative without any attention being given to its failure.

SUMMARY OF THE INVENTION

This invention has been developed for the purpose of obviating the aforesaid disadvantage of the discriminating apparatus of the type described. Accordingly, the invention has as its object the provision, in a particle color discriminating apparatus, of an automatic control device which is operative, when such apparatus is a grain particle discriminating apparatus, to adjust the amount of the grain particles supplied from the vibration feeder in accordance with any change in the proportion of foreign matter, such as grain particles of dissimilar colors or particles of dissimilar colors other than grain particles, incorporated in the grain particles so that the apparatus can operate with an unfailing ability to discrminate colors and without reducing the precision with which discrimination is effected, thereby eliminating the need to shut down the apparatus.

According to the invention, there is provided, in a particle color discriminating apparatus comprising a vibration feeder for feeding particles to be discriminated, a shooter for causing the particles fed from the feeder to flow downwardly in a path of a predetermined locus, photoelectric detecting means located in the vicinity of the path of flow of the particles flowing downwardly from the shooter for detecting particles distinct in color from the particles of intereset of predetermined color, an air ejector located beneath the photoelectric detecting means, and control means for controlling the actuation of the air ejector in accordance with an output signal of the photoelectric detecting means, an automatic control device comprising amplitude control means operative to control the amplitude of the vibration feeder including an electric circuit connected to an electric circuit of the control means for the air ejector.

According to the invention, there is also provided an automatic control device of the type described wherein the amplitude control means for the vibration feeder comprises a reversible electric motor and a variable resistor connnected to the reversible electric motor, wherein the control means for the air ejector comprises an electromagnetic valve connected to the air ejector, and wherein an electric circuit of the reversible electric motor and an electic circuit of the electromagnetic valve are interconnected through a control electric circuit so that the direction of rotation of the reversible electric motor is changed either to the normal direction or to the reverse direction by a signal generated when the number of air blasts ejected by the air ejector increases or decreases as compared with a predetermined reference number of air blasts to adjust the resistance value of the variable resistor, thereby to control the amount of the particles fed by the feeder in a stream.

According to the invention, there is also provided an automatic control device of the type described wherein the control electric circuit is constructed such that it causes the reversible electric motor to change its direction of rotation between the upper limit of the number of ejected air blasts ejected by the air ejector and the lower limit of the number of air blasts ejected thereby.

DESCRIPTION OF THE PREFERRED EMBODIMENT

Figure 1:
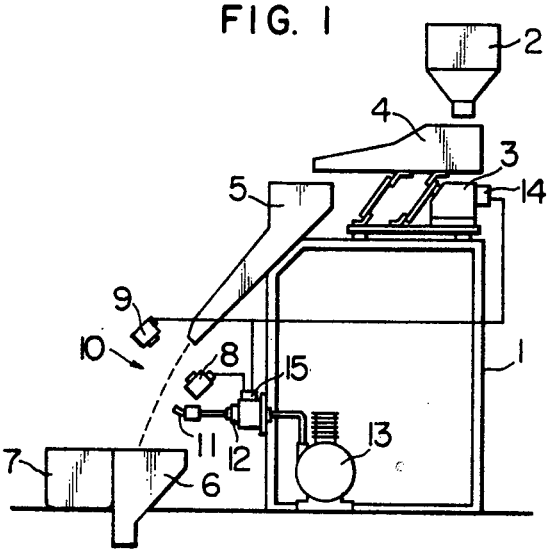
FIG. 1 is a schematic view of the particle color discriminating apparatus having one embodiment of the invention incorporated therein.

In FIG. 1, the particle color discrminating apparatus comprises a machine frame 1 having mounted in its upper portion a hopper 2, a vibration feeder 4 including a vibrator 3, and a shooter 5 in the indicated order from the top. Located below the shooter 5 are an acceptable particle (normal color particle) inlet port 6 and an inlet port 7 for unacceptable particle or foreign matter distinct in color from the acceptable particle. Photoelectric detecting means 10 comprising a light emitter 8 and a light receiver 9 is interposed between the shooter 5 and the two inlet ports 6 and 7 for detecting unacceptable particles. Located immediately below the photoelectric detecting means 10 is an air ejector 11 for excluding unacceptable particles which is connected to an air compressor 13 through an electromagnetic valve 12.

There are provided control means 14 for controlling the vibration of the vibrator 3, and control means 15 for controlling the opening and closing of the electromagnetic valve 12.

Figure 2:
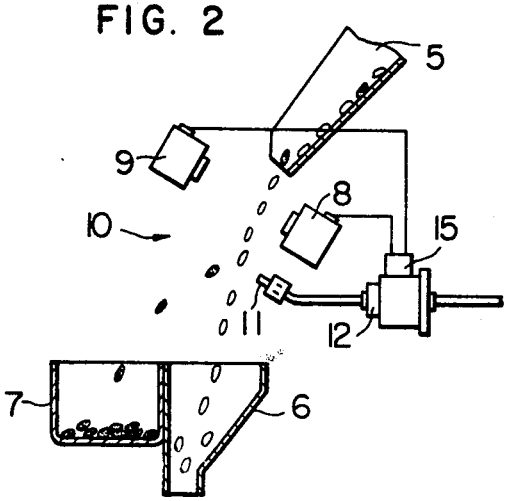
FIG. 2 is a view, on an enlarged scale, of the discriminating section of the color discriminator performing a discriminating action.

FIG. 2 shows, on an enlarged scale, the discriminating device of the particle color discriminating apparatus for performing a discriminating operation. In the figure, white particles indicate acceptable parcles and black particles represent particles distinct in color from the acceptable particles.

Figure 3:
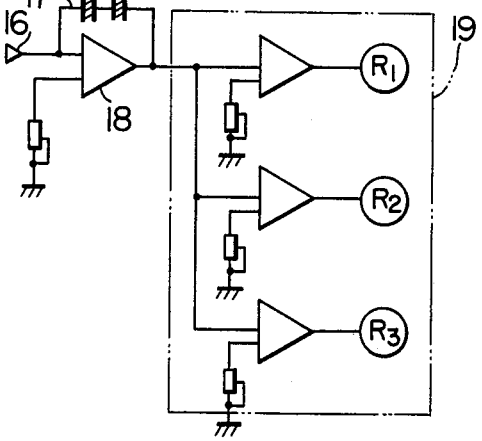
FIGS. 3 and 4 are diagrammatic views of the automatic control device.
Figure 4:
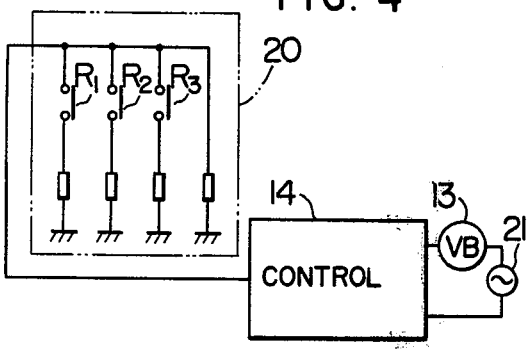

FIGS. 3 and 4 are diagrammatic views of the automatic control device according to the embodiment. An electric circuit 16 of the light receiver 9 is connected to an integrator circuit 17 and an amplifier circuit 18 which in turn are connected to a controlling section 19 of a comparator circuit. The controlling section 19 of the comparator circuit has relays $R_1$, $R_2$ and $R_3$ having contacts located in a controlled section 20 of the comparator citcuit connected to the control means 14 for the vibrator 3 which in turn is connected to a power source 21.

The operation of the control device according to the embodiment will be described by referring to the drawings. The particles to be discriminated fed to the hopper 2 in FIG. 1 drop onto the feeder 4 where the particles are subjected to vibration caused by the vibrator 3 and supplied to the shooter 5. The particles slide down along the shooter 5 and are released therefrom at its forward end into the air in a path of flow of a predetermined locus. The light receiver 9 on which light from the light emitter 8 is incident senses, by its electric circuit 16, the light that has passed through the stream of particles and judges the color of the particles based on the condition of the light. When the light sensed is not normal, the light receiver 9 produces a signal which is supplied to the control means 15 for the electromagnetic valve 12. Upon receipt of an abnormality indicating signal, the control means 15 opens the electromagnetic valve 12 to cause the air ejector 11 to eject air blasts to exclude the unacceptable particles that have caused the generation of the signal from the path of flow of the particles and to introduce same into the unacceptable particle inlet 7. The acceptable particles follow the path of flow of the predetermined locus into the acceptable particle inlet 6.

The abnormality indicating signal generated by the electric circuit 16 for the light receiver 9 is also inputted to the integrator circuit 17 and the amplifier circuit 18. The signal is amplified by the amplifier circuit 18 and converted by the integrator circuit 17 into a mean value for a predetermined time period which is supplied to the controlling section 19 of the comparator circuit. The relays $R_1$, $R_2$ and $R_3$ are actuated depending on the size of the mean value supplied to the controlling section 19. The contacts of the relays $R_1$, $R_2$ and $R_3$ are located in the controlled section 20 of the comparator circuit, and the control means 14 for the vibrator 3 controls the amplitude of the vibrator 3 as the contacts are opened and closed. More specifically, control of the vibrator amplitude is effected in such a manner that when the number of unacceptable particles in the stream of particles to be discriminated from the shooter 5 increases, the amplitude of the vibrator 3 is reduced thereby to reduce the amount of particles supplied from the vibration feeder 4 to the shooter 5; when the number of unacceptable particles decreases, the amount of particles supplied to the shooter 5 is increased. By this arrangement, the number of unacceptable particles in the stream of parcles to be discriminated released from the shooter 5 can be made substantially constant as they pass through the photoelectric detecting means 10 per unit period of time, thereby enabling discrimination of particles to be efficiently effected with a high degree of precision. The light beam emanating from the light emitter 8 may be either transmitted light or reflected light or both as desired. The use of any one of these two light beams or both enables unacceptable particles to be detected.

Figure 5:
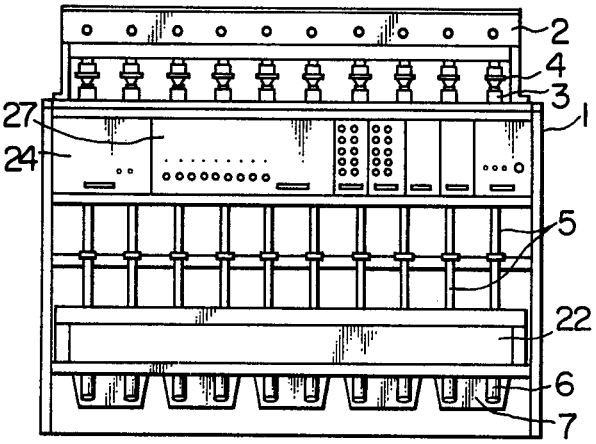
FIG. 5 is a front view of the particle color discriminating apparatus having another embodiment of the invention incorporated therein.
Figure 6:
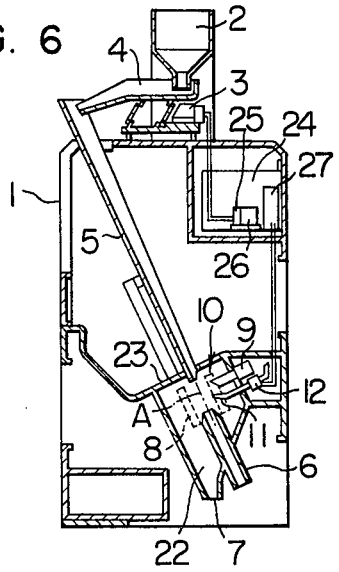
FIG. 6 is a sectional side view of the particle color discriminating apparatus shown in FIG. 5.

Another embodiment will be described by referring to FIGS. 5–7. As shown in FIGS. 5 and 6, the hopper 2 having a plurality of discharge ports is secured to the top of the machine frame 1 of the particle color discriminating apparatus, and a plurality of vibration feeders 4 each having vibrator 3 and a plurality of shooters 5 each connected to the outlet of one of the feeders 4 in a manner to be oriented in opposite directions are disposed below the hopper 2. The low end of each shooter 5 extends through a top wall 23 into a discriminating chamber 22 having the acceptable particle inlets 6 and unacceptable particle inlets 7 on an inclined bottom wall, the photoelectric detecting means 10 each comprising the light emitter 8 and light receiver 9 located in the upper portion, and the air ejectors 11 each interposed between the photoelectric detecting means and the acceptable particle inlet 6. The air ejectors 11 are connected to an air compressor, not shown, through the electromagnetic valves 12 located outside the discriminating chamber 22. The light receivers 9 and electromagnetic valves 12 are elecrically connected to a control circuit section 24. The vibrators 3 are connected to an amplitude adjusting section 25 having built-in variable resistors (not shown) and provided with reversible electric motors 26. The motors each have a circuit connected to the circuit of each electromagnetic valve 12 of each air ejector 11 through a control electric circuit 27.

The control electric circuit 27 will be described by referring to FIG. 7. An input branching terminal 28 provided in the circuit of each electromagnetic valve 12 of each air ejector 11 is connected in series to a voltage divider 29, an integrator circuit 30 and one input terminal of a setting circuit 31 having the other input terminal connected to a setter 32 for inputting the resistance value of the reference number of air blasts ejected by the air ejector 11. The setting circuit 31 is connected at its output side to one input terminal of a comparator 33 and one input terminal of another comparator 34. The integrator circuit 30 is connected at its output side to a branching circuit 35 connected to one input terminal of a comparator 36 and one input terminal of another comparator 37. The other input terminal of the comparator 33 and the other input terminal of the comparator 34 are grounded at 38. The other input terminal of the comparator 36 is connected to a setter 39 for inputting the resistance value of the upper limit number of air blasts ejected by the air ejector 11, and the other input terminal of the comparator 37 is connected to a setter 40 for inputting the resistance value of the lower limit number of air blasts ejected by the air ejector 11. The comparator 33 is connected at its output side to one input terminal of an AND circuit 41 and the comparator 34 is connected at its output side to one input terminal of an AND citcuit 43 through an inverter 42, and the comparator 36 and 37 are connected at their output side to the other input terminal of an AND circuit 41 and the other input terminal of another AND circuit 43 through a logical circuit 44. The AND circuits 41 and 43 are connected at their output side to the reversible electric motor 26 respectively through relays 45 and 46.

In operation, the particles to be discriminated in the hopper 2 are supplied by the action of each vibration feeder 4 to the respective shooter 5, from which the particles flow in a path of flow of a predetermined locus A and is introduced into the discriminating chamber 22. The transmitted light or reflected light emanating from the light emitter 8 and directed toward the path of flow of the particles of the locus A is detected by the light receiver 9 which generates an output signal supplied to the control circuit section 24. When the unacceptable particles or particles of dissimilar colors are detected, a signal from the control circuit section 24 actuates the electromagnetic valve 12 to cause the air ejector 11 to produce air blasts to blow the particles of dissimilar colors from the path of flow of the locus A into the unacceptable particle inlet 7. The particles of a predetermined color or acceptable particles flow in the path of flow of the locus A into the acceptable particle inlet 6, so that the acceptable particles can be distinguished from the unacceptable particles.

Figure 7:
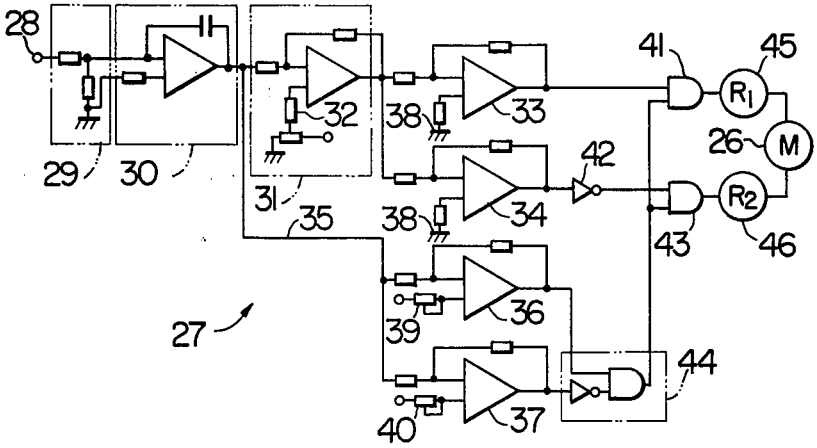
FIG. 7 is a diagram of the electric circuit of the automatic control device.

When there is a change in the porportion of particles of dissimilar colors incorporated in the particles to be discriminated, the input from the control circuit section 24 to the electromagnetic valve 12 is branched and supplied to the control electric circuit 27 shown in FIG. 7, in order to control the amount of particles flowing out of the vibration feeder 4 in accordance with the change in the proportion of particles of dissimilar colors.

The control electric circuit 27 is constructed as described previously by referring to FIG. 7. The operation of the circuit 27 will be described by selecting twenty (20) air blasts per second as a reference number of air blasts and setting the setter 32 at the resistance value of the aforesaid reference number of air blasts, by selecting thirty-five (35) air blasts per second as the upper limit number of air blasts and setting the setter 39 at the resistance value for the aforesaid upper limit number of air blasts and by selecting ten (10) air blasts per second as the lower limit number of air blasts and setting the setter 40 at the resistance value for the aforesaid lower limit number of air blasts. The vibration feeder 4 supplies grain particles to the shooter 5 by the vibrating action of the vibrator 3, and the grain particles flow in the path of flow of the locus A into the discriminating chamber 22 where the light transmitted or reflected by the particles of dissimilar colors is incident upon the light receiver 9 which supplies a signal to the control circuit section 24 which in turn generates a signal for actuating the electromagnetic valve 12 for the air ejector 11, so that air blasts are suitably ejected to remove the particles of discimilar colors from the path of flow of the locus A. In this air blasts ejecting process, an increase or decrease in the proportion of particles of discimilar colors incorporated in the particles flowing in the stream of the locus A causes an increase or decrease in the number of air blasts ejected by the air ejector 11. An output signal produced by the control circuit section 24 and indicating the frequency of air blast ejections is supplied from the input branching terminal 28 of the control electric circuit 24 through the voltage divider 29 to the integrator circuit 30 in which the signal is integrated to produce a mean value for a given period of time. The output signal of the circuit 30 is branched and supplied to the setting circuit 31 and comparators 36 and 37. In the setting circuit 31, the signal is corrected by the resistance value for the reference number of air blasts (20 air blasts per second) at which the setter 32 is set, to generate a differential amplifying signal of + or − which is supplied to the comparators 33 and 34. The output signals of the comparators 33 and 34 and the output signals of the comparators 36 and 37 transmitted through the logical circuit 44 are supplied to the AND circuits 41 and 43. Coincidence signals actuate the relay 45 or 46 respectively to rotate the reversible electric motor 26, to adjust a built-in variable resistor of the amplitude adjusting section 25 by means of a servomechanism. This causes a change in the amplitude of the vibration feeder 4 to regulate the amount of particles supplied thereby to the shooter 5 to a suitable level. When the number of air blasts exceeds the upper limit number of air blasts, the amplitude of the vibration feeder 4 automatically reduces to cause the flow rate of particles from the vibration feeder 4 to be reduced, so that the number of air blasts can be reduced. When the number of air blasts drops below the lower limit number of air blasts, the flow rate of particles from the vibration feeder 4 is automatically increased so that the number of air blasts can be increased. Thus, the electromagnetic valve 12 can be positively opened and closed as desired at all times.

From the foregoing description, it will be appreciated that the automatic control device for a particle color discriminating apparatus according to this embodiment operates such that a signal representing an increase or decrease in the number of air blasts ejected by the air ejector with respect to an arbitrarily selected reference number of air blasts between the upper limit number of air blasts and the lower limit number of air blasts is used to change the direction of rotation of a reversible motor either to the normal or the reverse direction thereby to adjust the resistance value of a variable resistor connected to the electric motor by a servomechanism, whereby the amplitude of the vibration feeder can be varied thereby to control the amount of particles flowing out of the vibration feeder. Thus it is possible to control the flow rate of particles to make it match the proportion of particles of dissimilar colors and also to enable the apparatus to operate within the safe limits of air ejection capabilities of the air ejector. With the control device of the type described, the apparatus can perform its air blast ejection and particle discriminating operation positively and stably and is free from the aforementioned failure of the apparatus of the prior art. The apparatus can operate with a high degree of ability and precision in discriminating particles at all times, so that finely selected particles can be produced smoothly and quickly on a mass production basis.

What is claimed is:

1. In a particle color discriminating apparatus comprising a vibration feeder for feeding particles to be discriminated, a shooter for causing the particles fed from the feeder to flow downwardly in a path of a predetermined locus, photoelectric detecting means located in the vicinity of the path of flow of the particles flowing downwardly from the shooter for detecting particles distinct in color from the particles of interest, an air ejector located beneath the photoelectric detecting means, and control means for controlling the actuation of the air ejector in accordance with an output signal of the photoelectric detecting means, an automatic control device comprising amplitude control means operative to control the amplitude of the vibration feeder including an electric circuit connected to an electric circuit of the control means for the air ejector.

2. An automatic control device as claimed in claim 1, wherein the amplitude control means for the vibration feeder comprises a reversible electric motor and a variable resistor connected to the reversible electric motor, wherein the control means for the air ejector comprises an electromagnetic valve connected to the air ejector, and wherein an electric circuit of the reversible electric motor and an electric circuit of the electromagnetic valve are interconnected through a control electric circuit so that the direction of rotation of the reversible electric motor is changed either to the normal direction or to the reverse direction by a signal generated when the number of air blasts ejected by the air ejector increases or decreases as compared with a predetermined reference number of air blasts to adjust the resistance value of the variable resistor, thereby to control the amount of the particles fed by the feeder in a stream.

3. An automatic control device as claimed in claim 2, wherein the control electric circuit is constructed such that it causes the reversible electric motor to change its direction of rotation between the upper limit of the number of ejected air blasts ejected by the air ejector and the lower limit of the number of air blasts ejected thereby.

* * * * *